United States Patent [19]

Anfilov et al.

[11] 4,291,971

[45] Sep. 29, 1981

[54] ELECTROGRAPHIC PHOTOCOMPOSING MACHINE

[76] Inventors: Igor V. Anfilov, ulitsa Udaltsova, 12, kv. 136, Moscow; Geny S. Ershov, prospekt Energetikov, 46, korpus 1, kv. 72; Eduard A. Kaidoshko, prospekt Lunacharskogo, 68, korpus 2, kv. 82, both of Leningrad; Jury B. Remizov, ulitsa Zelenogradskaya, 21, korpus 2, kv. 193; Anatoly L. Rozhenko, ulitsa Lavochkina, 6, korpus 2, kv. 215, both of Moscow; Gennady P. Suvorov, prospekt K.Marxa, 70, kv. 81, Leningrad; Boris G. Scherbatenko, Leninsky prospekt, 92, kv. 121, Moscow, all of U.S.S.R.

[21] Appl. No.: 72,556

[22] Filed: Sep. 4, 1979

[51] Int. Cl.[3] ..... G03G 15/00

[52] U.S. Cl. ..... 355/14 R; 354/5; 355/3 R; 355/3 CH

[58] Field of Search ..... 354/3, 5, 7; 355/3 R, 355/3 CH, 14 R

[56] References Cited

U.S. PATENT DOCUMENTS

| | | | |
|---|---|---|---|
| 3,670,633 | 6/1972 | Mason et al. | 355/40 X |
| 3,678,820 | 7/1972 | Chen et al. | 95/4.5 |
| 3,685,406 | 8/1972 | Chen | 95/4.5 |
| 3,693,516 | 9/1972 | Aron et al. | 354/7 |
| 3,693,517 | 9/1972 | Clark | 95/4.5 |
| 3,750,539 | 8/1973 | Mason | 95/4.5 |
| 3,759,149 | 9/1973 | Mason | 95/4.5 |
| 3;768,384 | 10/1973 | Mason | 95/4.5 |
| 3,827,063 | 7/1974 | Sinnott et al. | 354/5 X |

OTHER PUBLICATIONS

"Intelligent Copier Unifies Business Communication", Graphic Arts Monthly; May 1979, vol. 51, No. 5, pp. 168 l; 168 p; 168 r.

*Primary Examiner*—Fred L. Braun

*Attorney, Agent, or Firm*—Fleit & Jacobson

[57] ABSTRACT

An electrographic photocomposing machine including a rotary type carrier with negative images of characters and an electrophotographic section including a cylindrical intermediate image carrier with a drive. The intermediate image carrier has its surface coated with a photoconductive layer and a dielectric layer transparent in the sensitive area of the photoconductive layer. The electrophotographic section also includes a charging device having a main and two additional chargers arranged in direct proximity to the intermediate image carrier. Therewith, the luminous flux carrying the image of characters from the type carrier projects them on the intermediate image carrier portion between the additional chargers. In addition, the charging device has a main lamp for exposure of the intermediate image carrier, illuminating the latter in the area of action of the main charger, and an additional lamp for exposure of the intermediate image carrier, arranged downstream of the additional chargers in the direction of rotation of the intermediate image carrier.

1 Claim, 4 Drawing Figures

ELECTROGRAPHIC PHOTOCOMPOSING MACHINE

FIELD OF THE INVENTION

The present invention relates to electrographic engineering, and more particularly to electrographic photocomposing machines.

The invention can most advantageously be used in computer centers for printing computer output data. In addition, it can find application in printing houses for making proofs in textual information processing systems using photocomposition.

BACKGROUND OF THE INVENTION

At present, computer output data are printed out with the aid of alphanumeric printers using the same character faces and size. In rapid printing of such matter as reference books, cataloques, promotional booklets and other documents, the information printed on alphanumeric printers must be reprinted by conventional processes, which takes much more time.

In another application area, i.e. textual information processing systems using photocomposition, proofs are produced either on alphanumeric printers using ordinary paper or with the aid of automatic photocomposing machines on silver halide materials. In this case, electrographic or diazotype duplicating machines are used.

Known in the art is an electrographic photocomposing machine (cf. U.S. Pat. No. 3,768,384; Cl. 95-4,5; 1973) comprising a regularly rotating type carrier with a flashtube provided with a control unit, a photographic unit, and a line forming mechanism. The photocomposing machine also comprises an electrophotographic section including a regularly rotating cylindrical intermediate image carrier coated with a selenium layer and optically associated with the line forming mechanism, a charging device with a lamp for exposure of the intermediate image carrier, and a latent image developing device. The electrophotographic section also includes a powder image transferring device and a unit for fixing the powder image on the paper with heaters. The machine also comprises a computer unit electrically associated with the drive of the line forming mechanism and coupled to the control unit of the flashtube.

In this prior art photocomposing machine, the recorded image can be duplicated only once. This is due to the fact that the dark resistance of the selenium layer (the resistance of said layer in the absence of light) is not sufficiently great. In this case, the potential relief induced on this layer relaxes much faster than required for reproduction.

Also known is an electrographic photocomposing machine (cf. patent specification of U.S. Ser. No. 72,555 for an "Electrographic Photocomposing Machine" filed on Sept. 4, 1979, now U.S. Pat. No. 4,226,514) comprising a rotary type carrier with negative images of characters, provided with a flashtube having a control unit, a photographic unit arranged downstream of the type carrier along the beam from the flashtube, a line forming mechanism arranged downstream of the photographic unit along the beam from the flashtube and provided with a drive. The machine also comprises an electrophotographic section including a cylindrical intermediate image carrier coated with a photoconductive layer, optically associated with the line forming mechanism and having a drive of its own, a charging device having a main charger in direct proximity to the intermediate image carrier, and a main lamp for exposure of the latter. The electrophotographic section also comprises a latent image developing device contiguous with the surface of the intermediate image carrier and arranged in the direction of its rotation downstream of the charging device, and a powder image transferring device with a paper feed system having a drive, which ensures mechanical contact between a paper web, the intermediate image carrier and is arranged downstream of the latent image developing device in the direction of rotation of the intermediate image carrier. In addition, the electrophotographic section includes a device for cleaning the intermediate image carrier, arranged downstream of the powder image transferring device in the direction of rotation of the intermediate image carrier, and a unit for fixing the powder image on the paper with heaters arranged near the paper web, on the side of the powder image, downstream of the powder image transferring device in the direction of motion of the paper web. The photocomposing machine also comprises a computer unit electrically associated with the line forming mechanism drive and coupled to the drive of the intermediate image carrier.

However, the known electrographic photocomposing machine fails to provide for multiple reproduction of an image recorded once on the intermediate image carrier because the dark resistance of the photoconductive layer is relatively small, and the potential relief relaxes within a period of time much shorter than required for reproduction.

Besides, the use of a corona discharge to transfer the powder image to the paper in the powder image transferring device of the known machine results in an additional charge being introduced onto the photoconductive layer surface, which destroys the potential relief after one or two reproductions.

Therefore, for duplicating copies produced on such a machine additional duplicating facilities are required, and this is time-consuming and involves additional equipment, hence increasing the cost of printing.

SUMMARY OF THE INVENTION

It is an object of the present invention to provide for multiple reproduction of images from a singly obtained copy.

Another object of the invention is to cut down the cost of printing.

These objects are attained by providing, in an electrographic photocomposing machine comprising a rotary type carrier with negative images of characters, provided with a flashtube having a control unit, a photographic unit arranged downstream of the type carrier along the beam from the flashtube, a line forming mechanism arranged downstream of the photographic unit along the beam from the flashtube and provided with a drive, an electrophotographic section including a cylindrical intermediate image carrier with a photoconductive layer, optically associated with the line forming mechanism and provided with a drive of its own, a charging device having a main charger arranged in direct proximity to the intermediate image carrier and a main lamp for exposure of the intermediate image carrier, a latent image developing device contiguous with the surface of the intermediate image carrier and arranged in the direction of its rotation downstream of the charging device, a powder image transferring device with a paper feed system having a drive, which ensures mechanical contact between a paper web and the intermediate image carrier and is arranged downstream of the latent image developing device in the direction of rotation of the intermediate image carrier, a device for cleaning the intermediate image carrier, arranged downstream of the powder image transferring device in the direction of rotation of the intermediate image carrier, and a unit for fixing the powder image on the paper having heaters arranged near the paper web, on the side of the powder image, downstream of the powder image transferring device in the direction of motion of the paper web, and a computer unit electrically associated with the drive of the line forming mechanism, with a control unit of the flashtube and with the drive of the intermediate image carrier, according to the invention, wherein the intermediate image carrier also has a dielectric layer applied on the photoconductive layer and transparent in the sensitive area of the latter, the charging device being provided, for formation of a latent image in the dielectric layer of the intermediate image carrier, with two additional chargers arranged in tandem at a distance from the main charger in the direction of rotation of the intermediate image carrier, in direct proximity thereto, and an additional lamp for exposure of the intermediate image carrier, arranged immediately upstream of the latent image developing device, the main lamp being arranged so that its luminous flux illuminates a portion of the intermediate image carrier in the area of action of the main charger, and the line forming mechanism being so positioned with respect to the intermediate image carrier that the luminous flux carrying the image of characters from the type carrier projects them on the portion of the intermediate image carrier between the additional chargers.

The proposed electrographic photocomposing machine permits reproducing from 1 to 50 copies of printed texts at a rate of up to 60 characters per second or up to 6 m/min without using additionally duplicating equipment, which cuts down the cost of reproduction. The machine may operate on-line with computers or off-line with various data storages-punched tape, magnetic tape, magnetic disk.

The above advantages of the proposed machine over the prior art enable the reproduction time to be substantially reduced, and the machine can be used not only in large printing houses but also at medium and small facilities with limited floor space and equipment.

BRIEF DESCRIPTION OF THE DRAWINGS

The invention will now be described in greater detail with reference to specific embodiments thereof, taken in conjunction with the accompanying drawings, wherein.

DETAILED DESCRIPTION OF THE INVENTION

Figure 1:
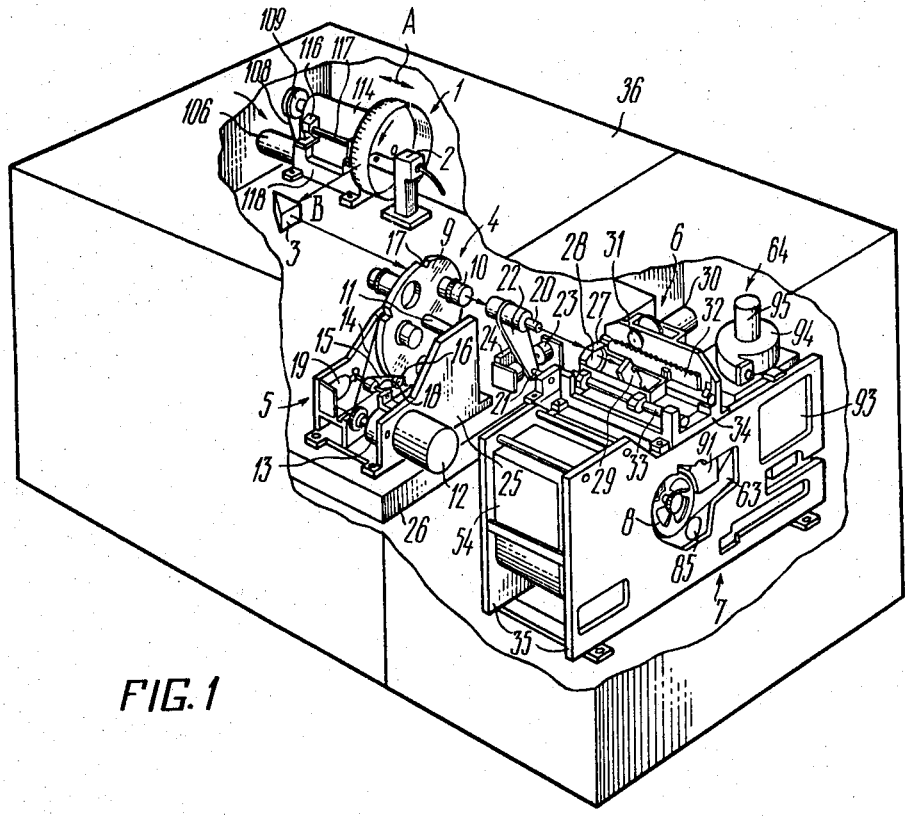
FIG. 1 is a general axonometric view of an electrographic photocomposing machine, according to the invention.

Referring now to FIG. 1, the electrographic photocomposing machine comprises a rotary type carrier 1 with negative images of characters, provided with a type face changing mechanism, a flashtube 2 having a control unit, and a drive. Arrow A in the drawing shows the direction of axial movement of the type carrier 1. Arranged in series along the beam from the flashtube 2 (indicated by arrow B) are a prism 3 which deflects the beam path, a photographic unit 4 with a driven type size changing mechanism 5, a line forming mechanism 6 with a drive, and an electrophotographic section 7.

The electrophotographic section 7 has a cylindrical intermediate image carrier 8 having a drive and being optically associated with the line forming mechanism 6.

The photographic unit 4 with the type size changing mechanism is essentially a turret 9 with five interchangeable lenses 10 (shown here in the working position). The turret 9 is mounted on a horizontal shaft 11 and rotated by an electric motor 12 via a reduction gear 13 and a belt drive 14. The lenses 10 are fixed in the working position by an arm 15 with a roller 16 which falls into recesses 17 made on the turret 9 and equal in number to the lenses 10. The arm 15 is mounted on a shaft 18 and is actuated by an electromagnet 19.

The photographic unit 4 also includes a Gallilean tube 20 mounted on an arm 22 rocking about a shaft 21, the arm 22 being actuated by electromagnets 23. The shaft 21 and solenoids 23 are accommodated in a casing 24. The photographic unit 4 and the type size changing mechanism 5 (with the exception of the Galilean tube 20) are enclosed in a housing 25. The type carrier 1 with the type face changing mechanism, the housing 25 of the photographic unit 4, the type size changing mechanism 5, and the casing 24 are secured on a horizontal plate 26.

The line forming mechanism 6 comprises a carriage 27 on which are mounted a lens 28 and a mirror 29 deflecting the light beam from the photographic unit 4 in a direction normal to the surface of the intermediate image carrier 8. The carriage 27 is moved along the generatrix of the intermediate image carrier 8 by a step motor 30 through a pinion 31 and a rack 32 made integral with the carriage 27.

The carriage 27 moves on a guide 33 secured on supports 34 which are attached to walls 35 of the electrophotographic section 7.

The type carrier 1 with the type face changing mechanism, the photographic unit 4 with the type size changing mechanism 5, the casing 24 of the Galilean tube 20, and the electrophotographic section 7 are accommodated in a lightproof housing 36.

The electrophotographic section 7 (FIG. 2) comprises the cylindrical intermediate image carrier 8 having its surface coated with a photoconductive layer 37 and a dielectric layer 38 transparent in the sensitive area of the photoconductive layer 37. Both layers 37 and 38 are supported by a substrate 39, in this case, an aluminum alloy.

The photoconductive layer 37 is made of amorphous selenium but can also be made of zinc oxide dispersed in a high resistance binder, a polyvinylcarbazole-based organic material and other materials having a specific volume dark resistance of at least $10^{14}$ ohms.cm. The dielectric layer 38 is essentially a polyfluoroethylene film or could be a film of polyethyleneterephthalate, polycarbonate, polystyrene and other materials with a volume resistivity exceeding the specific volume dark resistance of the photoconductive layer by at least two orders of magnitude.

The intermediate image carrier 8 is mounted on a shaft 40 rotated by a step motor 41 via a worm 42 and a worm gear 43. The shaft 40 is fitted in bearings 44.

Located in direct proximity to the intermediate image carrier 8 is a charging device 45 including a main charger 46 of the Scorotron type with coronizing wires and a grid connected to dc sources (not shown) and a main lamp 47 for exposure of the intermediate image carrier 8. The main lamp 47 is so arranged that its luminous flux illuminates a portion of the intermediate image carrier 8 in the zone of action of the main charger 46. In the embodiment under consideration, the lamp 47 is located above the main charger 46 and its luminous flux is reflected from a casing 48 (conventionally shown transparent) and is incident upon the intermediate image carrier 8 immediately below the charger 46. Then, arranged in tandem, in the direction of rotation of the intermediate image carrier 8 (indicated by arrow C) in direct proximity thereto and at a distance from the main charger 46, there are two additional chargers 49 and 50 of the charging device 45, similar to the main charger 46.

The line forming mechanism 6 (FIG. 1) is so arranged relative to the intermediate image carrier 8 that the luminous flux (arrow B) carrying the image of characters from the type carrier 1 projects the characters on the portion of the intermediate image carrier 8 (FIG. 2) between the additional chargers 49 and 50. The charging device 45 also comprises an additional lamp 51 for exposure of the intermediate image carrier 8, enclosed in a housing 52 (conventionally shown transparent). In this embodiment, the main lamp 47 and additional lamp 51 are essentially luminescent lamps although incandescent and other types of lamps can be used as well.

Arranged downstream of the charging device 45 in the direction of rotation of the intermediate image carrier 8 is a latent image developing device 53 contiguous with the surface of the intermediate image carrier 8. The device 53 comprises a housing 54 accommodating a bucket elevator 55 actuated by an electric motor 56 via a worm 57, a worm gear 58 and a shaft 59, as well as a toner dispenser (not shown). The shaft 59 is fitted in bearings 60.

Downstream of the latent image developing device 53, in the direction of rotation of the intermediate image carrier 8, there are arranged in series, a powder image transferring device 61 provided with a paper feed system 62 having a drive, which ensures mechanical contact between a paper web 63 and the intermediate image carrier 8, and a device 64 for cleaning the latter.

The powder image transferring device 61 includes an acceptor shaft 65 and the paper feed system 62. The latter has a roll 66 of the paper web 63, a tension roller 67 elastically pressed against the paper web 63 by a spring 68 through an arm 69 and a pin 70. The arm 69 is fitted in bearings 71. The paper feed system 62 also has guide rollers 72, discharge rollers 73 with a drive (not shown), and a device 74 for cutting prepared copies, including a stationary knife 75, a moving knife 76 fitted in bearings 77 and having a drive (not shown), and a stacker 78.

The acceptor shaft 65 has a two-layer elastic coating, the inner layer 79 being current-conducting and the outer layer 80 being insulating. The shaft 65 is rigidly secured on a pin 81 adapted to revolve in arms 82, rocking under the action of its own drive (not shown) with respect to an arm 83 fitted in bearings 84. The end of the pin 81 bears a disk 85 made of an insulating material, placed on the surface of which is a contact ring 86 electrically associated with the current conducting layer 79 and connected to a d-c source (not shown) via a brush 87 elastically pressed against the ring 86 by a spring 88. The spring 88 is attached to an insulator 89.

The device 64 for cleaning the intermediate image carrier 8 contains a furred roller 90 accommodated in a housing 91 (conventionally shown transparent) and associated through a filter 92 enclosed in a casing 93 (also shown transparent) with a fan 94 actuated by an electric motor 95. The roller 90 is adapted to revolve in arms 96 rocked by a drive (not shown) with respect to a pin 97 fitted in bearings 98. The force pressing the furred roller 90 against the intermediate image carrier 8 is adjusted by a screw 99.

The electrophotographic section 7 also comprises a unit 100 for fixing the powder image on the paper, including heaters 101 arranged near the paper web 63 on the side of the powder image, downstream of the powder image transferring device 61 in the direction of motion of the paper web 63. The unit 100 also includes a self-contained means 102 for contact heating of the paper web 63, arranged on the side of the latter opposite to the powder image and the heaters 101, and a means for cooling the powder image (not shown). In this embodiment, the heaters 101 are essentially iodine-cycle incandescent lamps accommodated in a reflector 103 above the paper web 63, while the contact heating means 102 is made as a massive plate with a tubular heater.

Figure 3:
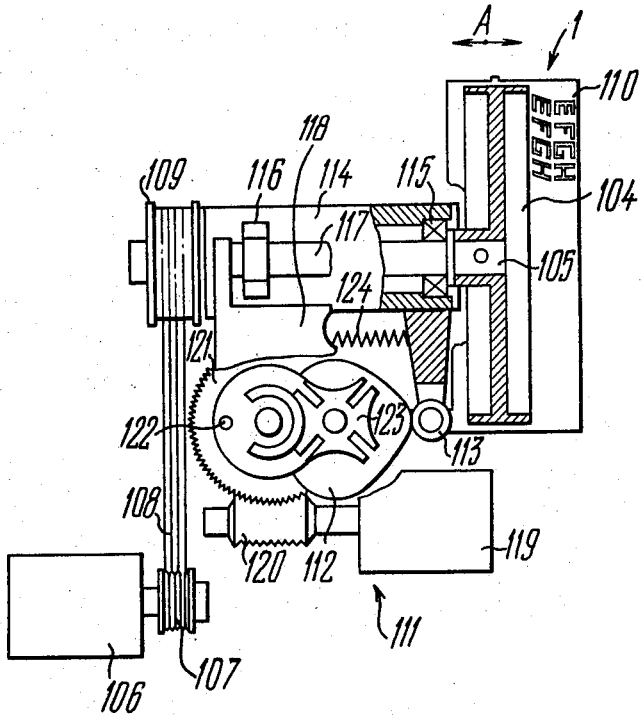
FIG. 3 is a longitudinal-section view of the type carrier with the type face changing mechanism, according to the invention.

The type carrier 1 (FIG. 3) in this embodiment is made in the form of a drum 104 rigidly fitted on a shaft 105. The drive of the type carrier 1 is essentially an electric motor 106 rotating the shaft 105 through a pulley 107, a belt 108 and a pulley 109 secured on the shaft 105. The surface of the drum 104 carries a film 110 with transparent characters (characters E, F, G and H are shown) arranged in several rows against a dark background. Each row contains characters of the same type face.

The type carrier 1 is provided with a type face changing mechanism 111 which, in this embodiment, is essentially a mechanism ensuring axial movement of the drum 104 and aligning the row of the required type face with the optical axis of the photographic unit 4. The type face changing mechanism 111 contains a positioning cam 112 which shifts the shaft 105 with the drum 104 and the film 110 in the directions indicated by arrow A. The type face changing mechanism 111 also included a roller 113 rigidly associated with the shaft 105 through a sleeve 114 and ball bearings 115. Through sliding bearings 116 the sleeve 114 moves along a shaft 117 accommodated in a casing 118. The cam 112 of the type face changing mechanism 111 is driven by an electric motor 119 via a worm 120, a worm gear 121 and a Maltese cross mechanism made up of a yoke 122 and a Maltese cross 123. A spring 124 provides for positive engagement between the cam 112 and the roller 113.

Figure 2:
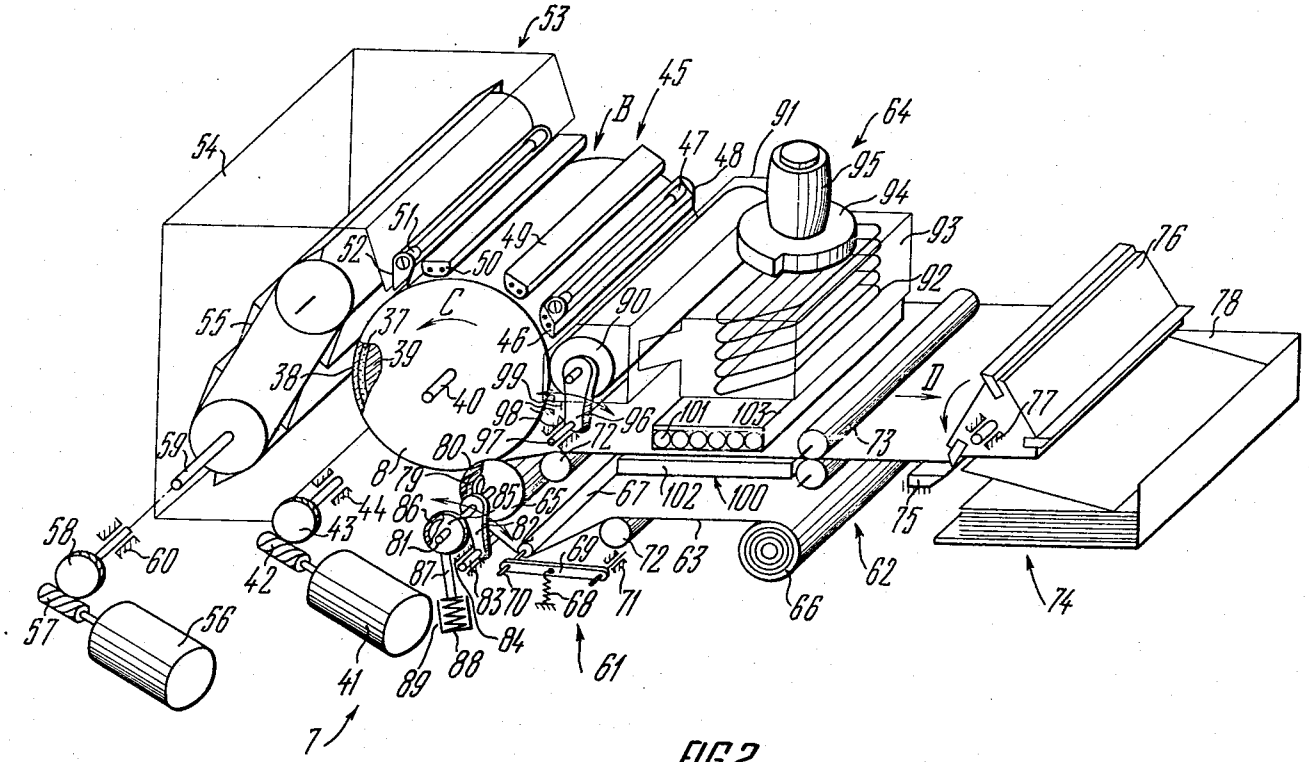
FIG. 2 is an axonometric view of the electrophotographic section of the machine, according to the invention.
Figure 4:
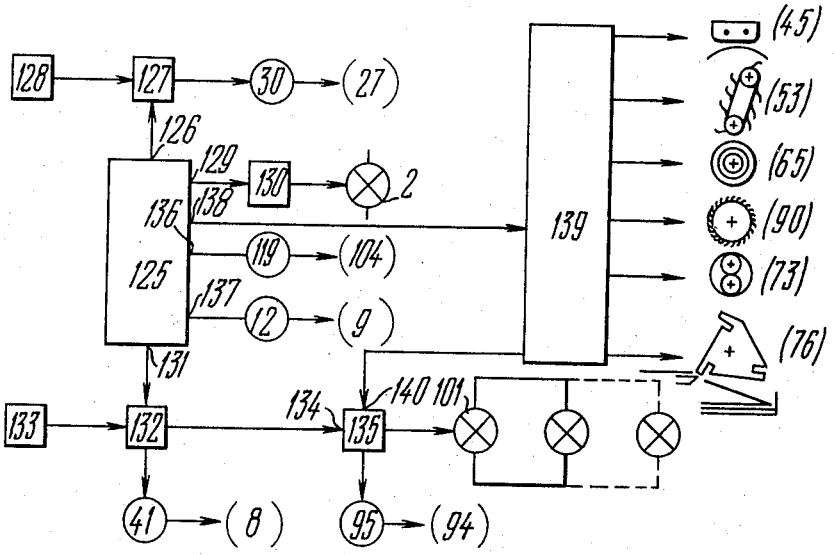
FIG. 4 is a block diagram of the control circuitry of the electrographic photocomposing machine, according to the invention.

A block diagram of the control circuitry of the proposed electrographic photocomposing machine is represented in FIG. 4. The input of a computer unit 125 is driven by a data input unit (not shown). Connected to an output 126 of the computer unit 125 is the control input of a switch 127 of the drive of the line forming mechanism 6 (FIG. 1). In this embodiment, the drive is essentially a start-stop mechanism including an electric pulse generator 128, the switch 127 and the step motor 30 actuating the carriage 27. An output 129 of the computer unit 125 is connected to a control unit 130 of the flashtube 2. An output 131 of the computer unit 125 is connected to the control input of a switch 132 of the intermediate image carrier 8 (FIG. 1), which is also a start-stop mechanism with a series arrangement including an electric pulse generator 133, the switch 132 and the step motor 41 actuating the cylindrical intermediate image carrier 8. An output of the switch 132 is connected to an input 134 of a unit 135 for pulsed actuation of the heaters 101. Connected in parallel with the unit 135 are the heaters 101 and the motor 95 of the fan 94 of the powder image air-cooling means 64 (FIG. 2).

Outputs 136 and 137 of the computer unit 125 are coupled, respectively, to the motor 119 of the type face changing mechanism 111 (FIG. 3) which moves the drum 104 of the type carrier 1 in an axial direction (indicated by arrow A) and to the motor 12 of the type size changing mechanism 5 (FIG. 1) which rotates the turret 9 with the lenses 10. The motors 119 and 12 are connected via the computer unit 125 to the switch 127 of the drive of the line forming mechanism 6 (FIG. 1). An output 138 of the computer unit 125 is connected to a switching unit 139 intended for selective actuation of the main components of the electrophotographic section 7 (FIG. 2) of the photocomposing machine: the charging device 45, the latent image developing device 53, the drive of the acceptor shaft 65, the drive of the furred roller 90, the drive of the discharge rollers 73, and the drive of the moving knife 76 of the cutting device 74. One of the outputs of the switching unit 139 is connected to an input 140 of the unit 135 for pulsed actuation of the heaters 101.

The electrographic photocomposing machine operates as follows.

In the write mode, the intermediate image carrier 8 (FIG. 2) moves line by line in the direction indicated by arrow C, actuated by the step motor 41 following instructions from the computer unit 125 (FIG. 4).

In this mode, some of the machine components are switched off so that no reproductions are made. Namely, the following components are inactive in the write mode: the latent image developing device 53 (FIG. 2), the powder image transferring device 61, the device 64 for cleaning the intermediate image carrier 8, and the unit 100 for fixing the powder image on the paper. In this case, the acceptor shaft 65 is backed away from the intermediate image carrier 8 and its current conducting layer 79 is disconnected from the d-c source, the drives of the discharge rollers 73 and moving knife 76 are deenergized, the furred roller 90 is backed away from the intermediate image carrier 8, and the unit 135 for pulsed actuation of the heaters 101 is switched off (FIG. 4).

When the coronizing wires and grid of the main charger 46 (FIG. 2) are energized from the d-c source and the main lamp 47 illuminates the photoconductive layer 37 at the same time, a charge is deposited on the surface of the dielectric layer 38 on the intermediate image carrier 8. In this case, the screened charge, i.e. the charge induced on the substrate 39, occupies the interface between the photoconductive layer 37 and the dielectric layer 38 due to the low resistance of the former. As the intermediate image carrier 8 moves further, in the absence of light, a charge of the opposite polarity is deposited on the surface of the dielectric layer 38 with the aid of the additional charger 49 whose coronizing wires and grid are energized from the d-c source. Due to the high dark resistance of the photoconductive layer 37, the screened charge occupies the interface between the photoconductive layer 37 and the substrate 39 after secondary charging.

Each text line is formed on the intermediate image carrier 8 (FIG. 1) during a pause which the latter makes as the carriage 27 of the line forming mechanism 6, driven by the step motor 30, moves along its generatrix. When the flashtube 2 comes on, the carriage 27 projects the selected character from the film 110 (FIG. 3) of the type carrier 1 (FIG. 1) on a preset coordinate of the line through the prism 3, the lenses 10, 28 and the mirror 29. As a result of exposure of the characters on the surface of the photoconductive layer 37 of the intermediate image carrier 8, in the illuminated portions of the layer 37 the screened charges are transferred, due to a decrease in its resistance, from the interface between the photoconductive layer 37 and the substrate 39 to that between the photoconductive layer 37 and the dielectric layer 38.

The required character on the type carrier 1 is selected by the computer unit 125 (FIG. 4) following instructions from the data input unit, which stops the carriage 27 (FIG. 1) via the switch 127 (FIG. 4) with the aid of the step motor 30 (FIG. 4) after the carriage 27 (FIG. 1) has reached the preset line coordinate, and which switches off the flashtube 2 via the control unit 130 (FIG. 4). After each text line is completed, the carriage 27 (FIG. 1) returns to the initial position.

To change the type face in the text, the computer unit 125 (FIG. 4) switches on the motor 119 of the type face changing mechanism 111 (FIG. 3) as soon as the carriage 27 (FIG. 1) reaches the required line coordinate, and the motor 119 (FIG. 3) turns the cam 112 with the aid of the Maltese cross mechanism through a predetermined angle. The cam 112 shifts the drum 104 with the film 110 in an axial direction through the roller 113, thereby aligning the row with the desired type face with the optical axis (arrow B) of the photographic unit 4 (FIG. 1).

To change the type size in the text, the computer unit 125 (FIG. 4) first activates the electromagnet 19 (FIG. 1), as soon as the carriage 27 reaches the required line coordinate, and this releases the turret 9 from its fixed position with the aid of the arm 15 and the roller 16; then the motor 12 of the type size changing mechanism 5 is switched on and turns the turret 9 through a predetermined angle with the aid of the belt drive 14, thereby aligning a respective lens 10 with the optical axis of the photographic unit 4. After the lens 10 has reached the operating position, the electromagnet 19 is de-energized and the arm 15 with the roller 16 locks the turret 9 in position. The changing of the lens 10 provides for a change of the type size on the intermediate image carrier 8 by changing the scale of photographing the characters from the film 110 (FIG. 3) of the type carrier 1, having the same basic type size thereon.

The Galilean tube 20 (FIG. 1) which, for example, doubles the scale is intended to extend the range of type sizes reproduced by the machine. If, for example, without the Galilean tube 20 the five lenses 10 enable reproduction of type sizes of 5, 6, 7, 8 and 10 points, with the Galilean tube 20 the same lenses 10 provide for type sizes of 10, 12, 14, 16 and 20 points.

In the photographic unit 4, the Galilean tube 20 is located on the rocking arm 22 actuated by the electromagnets 23 and, for reproduction of small type sizes, it is in a position remote from the optical axis of the photographic unit 4. To reproduce large type sizes, the computer unit 125 (FIG. 4) switches on the motor 12 (FIG. 1) and, at the same time, activates one of the electromagnets 23 and aligns the Galilean tube 20 with the optical axis of the photographic unit 4.

After the image has been exposed on the surface of the intermediate image carrier 8 (FIG. 2), as the latter rotates further, the surface of the dielectric layer 38 is grounded with the aid of the additional charger 50 whose coronizing wires are energized from an a-c source, its grid being grounded. Therewith, as a result of redistribution of the charges, a charge relief appears on the dielectric layer 38 at the same potential on the illuminated and dark portions of the image. Such a charge relief cannot be developed. As the intermediate image carrier 8 goes on rotating, the charge relief on the dielectric layer 38 becomes a potential relief as a result of illumination of the photoconductive layer 37 by the additional lamp 51 through the dielectric layer 38.

As a consequence of the above-described phenomena, a latent image appears on the surface of the dielectric layer 38, in the form of a potential relief in which all screened charges on the dark and light portions of the image are distributed along the interface between the photoconductive layer 37 and the dielectric layer 38. Due to the high resistance of the dielectric layer 38, which by far exceeds the dark resistance of the photoconductive layer 37, the obtained latent image may persist over a long period of time both in the light and in the dark. Therefore, it can be developed and transferred to the sensitive material a number of times.

After all (or part) of the surface of the intermediate image carrier 8 has been filled with information in the form of a latent image of the text, the photocomposing machine is switched over to the reproduction mode by instructions from the computer unit 125 (FIG. 4). In this case, the output 126 of the computer unit 125 receives a command which brings the carriage 27 of the mechanism 6 (FIG. 1) back to the initial position via the switch 127 and step motor 30. The output 131 of the unit 125 receives a command opening the switch 132 and actuating the intermediate image carrier 8 to continuous rotation through the step motor 41. No more commands arrive at the outputs 129, 136 and 137 of the unit 125, and this corresponds to the flashtube 2 being de-energized, absence of axial movement of the drum 104 of the type carrier 104 (FIG. 3) and absence of rotation of the turret 9 of the photographic unit 4 (FIG. 1). The input of the unit 125 receives a command which de-energizes the charging device 45 through the switching unit 139 and activates the latent image developing device 53, the drive of the discharge rollers 73 of the paper feed system 62 and of the moving knife 76 of the cutting device 74. Activated at the same time is the drive of the powder image transferring device 61 which brings the acceptor shaft 65 close to the intermediate image carrier 8 with simultaneous connection of the current-conducting layer 79 (FIG. 2) of the shaft 65 to the d-c source. The input 140 of the unit 135 (FIG. 4) receives a command from the unit 139, which activates the heaters 101 and the fan 94 via the motor 95, whereby both start operating continuously.

As the intermediate image carrier 8 (FIG. 2) rotates continuously, the latent image thereon is developed in the device 53 within each cycle. The developed latent image is transferred to the paper web 63 in the powder image transferring device 61, and fused into the paper web 63 in the unit 100, and the finished copies are withdrawn from the machine with the aid of the discharge rollers 73, cut along the galley length in the cutting device 74, and stacked in the stacker 78.

The latent image on the dielectric layer 38 of the intermediate image carrier 8 is developed with the aid of the rotating elevator 55 by spraying the layer 38 with a developer consisting of a mixture of a toner and a carrier, the elevator 55 being enclosed in the housing 54. As the developer is being spent, more toner is added by means of the toner dispenser.

To transfer the powder image on the paper web 63 use is made of the acceptor shaft 65 which performs two functions: it creates an electric field in the powder image under the effect of the potential in the current-conducting layer 79, which field transfers the powder to the paper web 63 and feeds the latter through the rollers 67 and 72 from the roll 66 toward the intermediate image carrier 8 owing to the mechanical contact between the paper web 63 and the intermediate image carrier 8.

The discharge rollers 73, having a drive with a friction clutch, provide for optimal tension of the paper web 63 without the latter's slipping through the powder image transfer zone and with reliable separation of the finished copies from the intermediate image carrier 8, the finished copies being delivered through the unit 100 for fixing the powder image on the paper into the cutting device 74.

During the fixing of the powder image in the unit 100, the paper web 63 is preheated by the contact heating means 102 (FIG. 2) to a temperature close to the melting point of the powder, and then the image is finally fused into the paper by means of the heaters 101. The preheating of the paper web 63 and blowing of the powder image in the zone of action of the heaters 101 are necessary to prevent a burn-through of the image (its appearance on the back side of the paper), bearing in mind that heat is transferred from the heaters 101 to the powder by way of radiant heat exchange at which the powder which is darker than the paper is heated to a greater extent. The heat transferred into the paper causes a burn-through of the image, which can be eliminated by minimizing the temperature difference between the paper and powder during heating; with the powder being blown with cold air, whereby the heat is transferred to the surrounding atmosphere rather than to the paper.

The finished copies are cut along the galley length in the cutting device 74 by the stationary knife 75 and the moving knife 76. The latter rotates cyclically through 120° after the emergence of a next galley at the stacker 78.

Multiple reproduction of an image is made possible owing to the prolonged persistence of the potential relief in the dielectric layer 38 of the intermediate image carrier 8 and by a particular technique of transferring the powder image with the aid of the acceptor shaft 65, whereby an electric field is created in the powder image without additional charges being introduced on the surface of the dielectric layer 38 of the intermediate image carrier 8. This is achieved by virtue of the fact that the insulating layer 80 of the acceptor shaft 65 provides, owing to proper selection of the resistivity (about $10^{11}$ ohms.cm), for practically zero current in the powder image transfer zone and high-quality transfer of the image, owing to equalization of the electric field over the entire area of contact between the acceptor shaft 65 and the intermediate image carrier 8, even in the presence of imperfections in the paper web 63 and in the photoconductive and dielectric layers 37 and 38. In the proposed electrographic photocomposing machine, up to 50 copies of the same quality can be produced from a single latent image.

Note that the cost of reproduction is low, owing to the processes of image formation and duplication being conducted in the same machine.

In the cource of reproduction, at the moment when the leading edge of a galley on the intermediate image carrier 8 (FIG. 2) of the last copy enters the area between the acceptor shaft 65 and the furred roller 90, the output 138 (FIG. 4) of the computer unit 125 receives a command activating, via the switching unit 139, the drive of the device for cleaning the intermediate image carrier 8, whereby the rotating furred roller 90 is brought close to the surface of the dielectric layer 38 of the intermediate image carrier 8. The roller 90 cleans the surface of the dielectric layer 38 within one or two revolutions of the intermediate image carrier 8, and then returns to the initial position.

During cleaning of the surface of the dielectric layer 38, the coronizing wires of the charger 46 may, if necessary, be energized from an a-c source, its grid may be grounded, and the lamp 47 may be switched on. Then, the latent image will be erased more thoroughly. However, experimental data suggest that, in the absence of accumulated space charges in the photoconductive layer 37, this step is superfluous.

After a desired number of copies have been obtained, the machine is switched over to the write mode again, following commands from the unit 125 (FIG. 4), then the next galley is formed on the intermediate image carrier 8.

In the case where a single copy is to be produced (without duplication), the machine may operate in the write and reproduction modes at the same time. In this case, the intermediate image carrier 8 continuously moves line, by line following commands from the computer unit 125 (FIG. 4), and the device 64 for cleaning the intermediate image carrier 8 is constantly on, i.e., the roller 90 is always in contact with the surface of the latter. The rest of the machine components, except for the cutting device 74 (FIG. 2), are activated. The unit 100 for fixing the powder image on the paper operates in a mode corresponding to writing and reproduction of a single image. Therewith, the paper web 63 irregularly moves line by line. In this case, for adequate fusion of the powder image into the paper web 63, the heaters 101 are periodically actuated by the unit 135 for a definite period of time corresponding to the time of travel of the paper web 63 (FIG. 2) in the zone of the reflector 103 of the heaters 101. The printed copies come out in the form of variable-length galleys which are then cut manually in accordance with the process wherein they will be used.

Thus, in the proposed electrographic photocomposing machine, multiple reproduction is possible from a single image at a low cost.

What is claimed is:

1. An electrographic photocomposing machine comprising:

a rotary type carrier with negative images of characters;

a flashtube of said rotary type carrier, generating a beam and having a control unit;

a photographic unit arranged downstream of said rotary type carrier along the beam from said flashtube and having a drive;

a line forming mechanism arranged downstream of said photographic unit along the beam from said flashtube;

an electrophotographic section arranged downstream of said line forming mechanism along the beam from said flashtube;

a cylindrical intermediate image carrier optically associated with said line forming mechanism and having a drive;

a photoconductive layer of said intermediate image carrier;

a dielectric layer of said intermediate image carrier, applied on said photoconductive layer and transparent in the sensitive area of said photoconductive layer;

a computer unit electrically associated with said drive of said line forming mechanism, with said control unit of said flashtube, and with said drive of said intermediate image carrier;

a charging device of said electrophotographic section, arranged in proximity to said intermediate image carrier;

a first charger of said charging device, arranged in direct proximity to said intermediate image carrier;

a first lamp of said charging device, for exposure of said intermediate image carrier, illuminating a portion of said intermediate image carrier in the area of action of said first charger;

a second charger of said charging device, arranged at a distance from said first charger in the direction of rotation of said intermediate image carrier, in direct proximity thereto;

a third charger of said charging device, arranged at a distance from said second charger in the direction of rotation of said intermediate image carrier, in direct proximity thereto, the luminous flux which carries the image of said characters from said type carrier projecting said characters on the portion of said intermediate image carrier between said second and third chargers;

a second lamp for exposure of said intermediate image carrier, arranged downstream of said third charger in the direction of rotation of said intermediate image carrier;

a latent image developing device of said electrophotographic section contiguous with the surface of said intermediate image carrier and arranged in the direction of its rotation downstream of said charging device;

a powder image transferring device of said electrophotographic section, provided with a paper feed system including a paper web with a powder image applied on its first side, wherein said powder image transferring device ensures mechanical contact between said paper web and said intermediate image carrier and is arranged downstream of said latent image developing device in the direction of rotation of said intermediate image carrier;

a device for cleaning said intermediate image carrier of said electrophotographic section, arranged downstream of said powder image transferring device in the direction of rotation of said intermediate image carrier;

a unit of said electrophotographic section for fixing the powder image on the paper; and heaters of said unit of said electrophotographic section for fusing the powder image into the paper, arranged near said paper web on its first side, downstream of said powder image transferring device in the direction of motion of said paper web.

* * * * *